US006475297B1

(12) United States Patent
Rafferty et al.

(10) Patent No.: US 6,475,297 B1
(45) Date of Patent: Nov. 5, 2002

(54) METHOD FOR FORMING CORROSION RESISTANT COATING ON AN ALLOY SURFACE

(76) Inventors: Kevin Rafferty, 193 Countryview Dr., Harrison, OH (US) 45030; Bruce Rowe, 695 Overland Ave., Cincinnati, OH (US) 45226

( * ) Notice: Subject to any disclaimer, the term of this patent is extended or adjusted under 35 U.S.C. 154(b) by 0 days.

(21) Appl. No.: 09/399,446

(22) Filed: Sep. 20, 1999

Related U.S. Application Data

(62) Division of application No. 09/105,284, filed on Jun. 26, 1998, now Pat. No. 5,997,604.

(51) Int. Cl.[7] ..... C23C 22/00

(52) U.S. Cl. ..... 148/240; 148/283; 427/191; 427/205; 427/405; 427/419.1

(58) Field of Search ..... 427/191, 205, 427/405, 419.1; 148/283, 240

(56) References Cited

U.S. PATENT DOCUMENTS 4,937,042 A 6/1990 Perkins et al.
5,263,641 A 11/1993 Rafferty et al.
5,334,417 A 8/1994 Raferty et al.
5,366,765 A 11/1994 Milaniak et al.
5,482,578 A 1/1996 Rose et al.
5,500,252 A * 3/1996 Meelu ..... 427/376.3
5,650,235 A * 7/1997 McMordie et al. ..... 428/610
5,795,659 A 8/1998 Meelu et al.
5,866,271 A * 2/1999 Stueber et al. ..... 428/545
5,867,762 A 2/1999 Rafferty et al.

* cited by examiner

*Primary Examiner*—John Sheehan
*Assistant Examiner*—Andrew L. Oltmans

(57) ABSTRACT

Corrosion resistant metal, either platinum or MCrAlY is bonded to a corrosion sensitive metal such as nickel based superalloys by coating the surface with the corrosion resistant metal particles held in a binder and covering this with a metalide generating tape. This is then heated to cause the formation of the metalide coating on the metal surface, which in turn, bonds the corrosion resistant metal to the surface.

10 Claims, 1 Drawing Sheet

METHOD FOR FORMING CORROSION RESISTANT COATING ON AN ALLOY SURFACE

This application is a division of application Ser. No. 09/105,284 filed Jun. 26, 1998 now U.S. Pat. No. 5,997,604.

BACKGROUND OF THE INVENTION

Metals such as stainless steel as well as nickel, cobalt, titanium and tungsten based superalloys are frequently coated with a corrosion resistant material. One such corrosion resistant coating is a metalide coating, in particular, nickel aluminide coating. One method of applying such a metalide coating is disclosed in U.S. Pat. No. 5,334,417. Platinum and MCrAlY wherein the M represents a nickel cobalt alloy also form corrosion resistant surfaces. These metals cannot be applied as coatings using braze alloys. The melt suppressants in the braze alloy promote oxidation and corrosion and therefore are unsuitable for this application. As such, these coatings are typically applied using a plasma spray. The plasma spray apparatus is expensive and not particularly suitable for small or localized repairs.

SUMMARY OF THE INVENTION

Accordingly, it is an object of the present invention to provide a method to form a platinum or MCrAlY coating onto a superalloy surface without the use of a plasma spray.

Further, it is an object of the present invention to use a metalide coating to bond platinum or MCrAlY to the surface of a superalloy. The platinum or MCrAlY coating is formed on the surface of the metal part by coating the surface of the metal part with particles of platinum or MCrAlY and subsequently forming a metalide coating on the surface. Preferably the MCrAlY or platinum particles are held on the surface of the metal part using a binder such as PTFE or acrylic. The metalide coating is preferably applied by first forming a tape which includes metal such as aluminum, a halide carrier, metal oxide and a binder. The tape is placed over the coating of the corrosion resistant metal particles and the part being coated is then heated to cause the aluminum to react with the halide to form a metal halide compound which in turn will react with the metal surface, forming an aluminide coating. The aluminide coating bonds the corrosion resistant metal particles to the surface of the part being coated.

In an alternate embodiment of the present invention the corrosion resistant metal particles are simply blended with a binder such as polytetrafluoroethylene and placed onto the surface of the part being coated and a metalide tape is then placed over the corrosion resistant metal particle tape. The part is then subjected to a heating cycle to form the metalide coating to bond the corrosion resistant particles to the surface of the part.

In another alternate embodiment of the present invention the corrosion resistant particles are suspended in a liquid binder or adhesive and applied to the side of the aluminide coating tape to be placed against the part being coated.

In a further alternate embodiment of the present invention, a single layer coating tape includes platinum aluminum alloy in combination with optionally metal such as aluminum, the halide carrier, metal/oxide and binder. This tape is applied directly to the surface of the metal part being coated and is again subjected to a heat cycle which causes the platinum aluminum alloy to react with the halide forming the platinum aluminum halide complex. This in turn reacts the surface of the metal being coated, forming a platinum aluminide coating which is corrosion resistant.

The objects and advantages of the present invention will be further appreciated in light of the following detailed descriptions and drawings in which:

DETAILED DESCRIPTION

Figure 1:
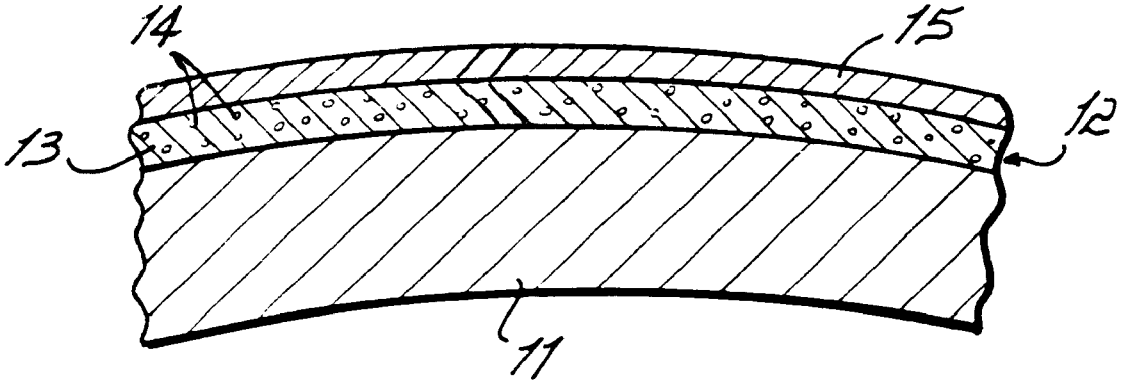
FIG. 1 is a cross-sectional view broken away depicting one method of practicing the present invention.

As shown in FIG. 1, a metal part 11 is coated with a slurry 12 of a binder 13 and corrosion resistant metal particles 14. This in turn is covered with an metalide coating system 15.

The metal part 11 can be a wide variety of different alloys including stainless steel as well as nickel, cobalt, titanium and tungsten based superalloys. These include Rene 35, Rene 41, Rene 77, Rene 80, Rene 80H, Rene 95, Rene 125, Rene 142, Inconel 713, and Inconel 718, Hastelloy X, Wasp alloy, Haynes 188, L605, X-40, and MarM-509. In particular, the part 11 can be a part from a jet engine which requires exceptional corrosion resistance.

The binder is any adhesive typically used to bind braze tapes to a metal surface. These binders are commercially available and include glycerol base binders, petroleum based binders, and organic polymeric systems such as acrylic base binders, alginate based binders, and gelatin based binders. Other materials such as starch and organic polymeric systems which can be applied as a paste at room temperature can be employed. Suitable binders can be purchased, for example, from Metal Methods, Fusion, Inc., Wall Colmonony Corporation, and Vitta Corporation.

The binders are formed into a liquid or paste according to the instructions for the binder. If desired, these compositions can be combined with from about 1 to 6% by weight of fibrillated polytetrafluoroethylene powder. A similar binder system is disclosed in U.S. Pat. No. 5,263,641.

The binder 13 is combined with finely ground particulate metal 14 to form a binder slurry 15. The metal is a corrosion resistant metal and is specifically platinum, platinum aluminum alloy or MCrAlY. Generally the particle size of the corrosion resistant metal will be from about 0.2 micron to about 80 mesh with sub-10 micron preferred. The amount of corrosion resistant metal in the binder slurry should be sufficient to provide 0.1 to about 5 grams of corrosion resistant metal per square inch of the metal surface. This, of course, can be changed significantly, depending upon the particular applications. Preferably 0.5 to 2 grams of corrosion resistant metal per square inch is applied and generally about 1 gram per square inch is preferred.

The MCrAlY itself is a well known commercially available corrosion resistant alloy. The M represents nickel, cobalt or a nickel cobalt alloy. One commercially available, MCrAlY includes 42 to 43% cobalt, 30% nickel, 20% chromium,0.2 to 0.4% yttrium, and 6 to 9% aluminum. This can be a purchase from Praxair. Other companies, of course, sell other MCrAlY coatings which generally are similar to these ratios.

To apply the coating, the corrosion resistant metal is combined with the binder which is then applied to the metal surface using a squeegee or a doctor blade to apply a relatively even coating. The thickness is controlled to establish the desired amount of metal coating per area. Metalide forming system 15 is then applied over the coating 12. Although a paste or slurry can be used, system 15 is preferably a tape. If the metalide tape is applied before the corrosion resistant coating composition dries, no adhesive is required. If the tape is applied after the coating dries, an adhesive may be required.

The metalide 15 tape includes elemental metal, a filler, a halogen carrier composition and a binding composition. The binding composition is preferably fibrillated polytetrafluoroethylene although other known binders can be used. Fibrillated PTFE polymer used in the present invention is a high molecular weight PTFE resin produced by emulsion polymerization. The PTFE polymers have a broad molecular weight range of 10 to 20 million and are commercially available products.

Preparation of these polymers, which is described in U.S. Pat. Nos. 2,510,112, 2,587,357, and 2,685,707 involves well known emulsion polymerization techniques wherein the tetrafluoroethylene under pressure in water containing an emulsifying reagent is reacted with a water soluble free radical catalyst. The emulsion produced is coagulated, washed, and dried.

The average particle size of the polymer is 50 to 560 microns. Although polymers having larger or smaller particle size will function in the present invention. The PTFE used in the present invention is a fibrillated polytetrafluoroethylene sold by Du Pont of Wilmington, Del. under the trade designation Teflon® 6C.

The PTFE, acts to bind the elemental metal carrier and filler. The PTFE when vaporized in a nonoxidizing environment also acts to clean both the metal surface and particle surfaces. Generally, from about 1% to about 6% by weight fibrillated polytetrafluoroethylene is employed and preferably about 3%.

In addition to the binder, tape 15 includes a powdered (−100 preferably at least −325 mesh) metal or metal alloy. Suitable metals include aluminum, chromium, chromium aluminum alloy, silicon aluminum alloy, titanium aluminum alloy, vanadium aluminum alloy, and vanadium. These metals will react with halide ions to form metal halide compounds which in turn react with basis metal to form an alloy as the halogen is liberated. The metal powder should be from about 1 to about 90% of the tape by weight with generally 50 to 65% with 58% being preferred.

The tape also includes a filler preferably a metal oxide. This basically keeps the metal particles from the aluminide coating tape from sintering or binding to the surface of the parts during processing, an undesirable result. Generally, the filler will be calcined aluminum oxide or titanium dioxide with aluminum oxide being preferred. Generally, the filler will form 8% to 95% of the tape by weight with 37% being preferred.

Finally, the tape 15 includes a halogen source which will react with the metal to carry the metal ions to the surface of the basis metal where they will react with the base metal (i.e. part 11). Generally, suitable halide sources include ammonium chloride and ammonium fluoride. Typically, 1% by weight halide carrier is used.

The individual components are measured and combined in a ball mill or other low shear mixtures such as a KD mixer with kinetic dispersion or a vibratory mixer. In a ball mill, the mixer is run at about 200 rpm with stainless steel balls for about 20 to 40 minutes with 25 minutes generally being acceptable.

The mixture is then separated from the steel balls and rolled between adjustable rollers to a thickness of about 0.002" to about 0.25". When being rolled, the mixture is separated from the rollers by separation sheets, preferably a metal foil such as aluminum foil.

The mixture is rolled between pressure rollers in the first direction and then the sheet folded upon itself in half and rolled again in a direction 90° from the initial rolling. This can be repeated until the desired thickness and consistency is obtained.

The formed tape is very malleable and is cut to the desired size to cover the surface to be coated. The tape 15 is applied over the corrosion resistant metal coating 12. Generally, the thickness of the metal aluminide tape is adequate to apply a coating of up to thirty thousandths, generally 1 to 4 mills. As previously indicated, an adhesive (not shown) can be used to bind the tape 15 to the coating 12.

Instead of applying the slurry 12 to the surface of the part, it can be applied to the tape 15 in the desired thickness and then placed on the surface of the part being repaired. The adhesive in the slurry will hold the tape 15 to the part.

Further tape 15 can be replaced with a slurry by substituting most or all of the polytetraflourethylene with the binder used in slurry 12.

Tape 15 can also be partially sintered to form a preform and adhered to slurry 12. But this is less preferred.

The metal part 11 is then placed in an oven and heated to a temperature of about 1950 to 2000° Fahrenheit or 2 to 6 hours, generally about 5 hours, in a hydrogen atmosphere, or, alternatively, an inert or vacuum atmosphere.

The process causes a chemical reaction to occur in which the halide compound breaks down to form halide ions which react with the metal (or metal alloy) atoms forming the metal halide compound. When the metal halide contacts the base metal surface. The metal in the metal halide compound is reduced to elemental metal which can alloy with the base metal. This in turn binds the corrosion resistant particles, i.e. the Pt or MCrAlY to the surface of the metal part forming the corrosion resistant metal coating.

Figure 2:
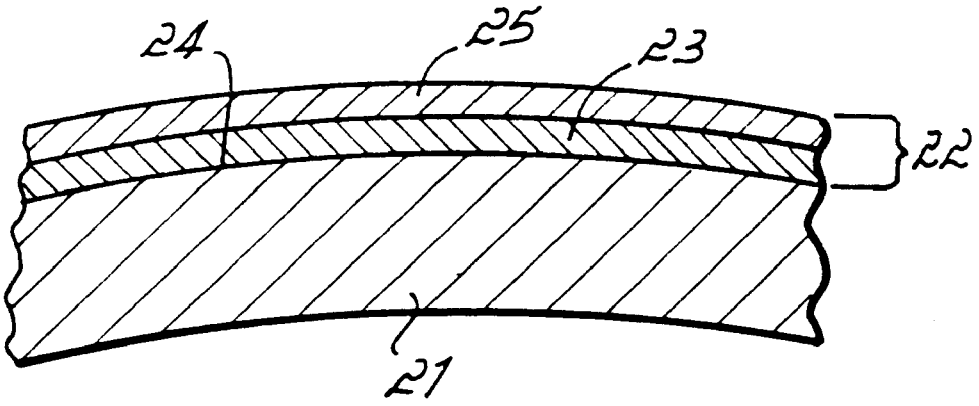
FIG. 2 is a cross-sectional view broken away depicting an alternate embodiment of present invention.

In an alternate embodiment of the present invention as shown in FIG. 2, a portion of a metal part 21 is covered with a dual layer tape 22. The dual layer tape 22 includes a lower layer 23 resting on the surface 24 of the metal part 21 with an upper layer 25 bonded to or adhering to the upper surface of the first layer.

The first layer or lower layer 23 comprises the corrosion resistant metal particles, i.e. Pt, Pt—Al or MCrAlY with a polytetrafluoroethylene binder. Preferably, the layer includes 1 to 6% by weight of the fibrillated polytetrafluoroethylene with the remainder being the corrosion resistant metal. The thickness of the layer 23 can be varied to establish the desired weight per square inch of the corrosion resistant metal on surface 24. The upper layer 25 is the same as the layer 15 shown in FIG. 1.

The layers are bonded together by placing one on top of the other and running these through compression rollers which causes the two layers 23 and 25 to bond together. This is then cut to size and placed onto the metal surface 24. If desired, an adhesive layer (not shown) can be employed to temporarily bond the tape 22 to the metal surface 24. The part is then heated at 1950–2000° Fahrenheit for 2 to 6 hours in the inert atmosphere. This bonds the corrosion resistant particles to the surface with a metalide coating.

A single layer tape can also be used to form the corrosion resistant coating of the present invention. With a single layer tape, the corrosion resistant metal is a platinum/aluminum alloy as opposed to MCrAlY or Pt. The Pt—Al alloy is platinum—(nickel, on cobalt)—aluminum alloy or platinum aluminum alloy where the molar percent of platinum is 20–80, nickel and/or cobalt 0 to about 20 and aluminum 20 to about 80%.

This Pt—Al alloy replaces a portion or all of the powdered metal or metal alloy in the metalide tape 15. Preferably, of the 50 to 65% of the aluminide tape which is powdered metal, 10% to 100% of this powdered metal should be the P—Al alloy. The remaining metal is Pt or MCrAlY. The tape is then formed as previously described and applied to a metal surface and heated at 1950–2000% F. for 2 to 6 hours in an inert environment. The halide carrier will form halide ions which will react with the platinum aluminum alloy. This alloy in turn will react directly with the metal surface to form the corrosion resistant coating.

The present invention can also be used to apply other particulate coatings including ceramics and cermets such as CoWC to a metal surface-general of a superalloy. Basically any metal on particle which can withstand application temperatures of about 1950° F. can be applied to a surface using the present invention. To do so, the Pt or MCrAlY is simply replaced by the desired particulate coating.

The present invention, of course, advantageously eliminates the need for expensive equipment to apply the corrosion resistant coating. Further, it very uniquely uses an aluminide coating to bond the corrosion resistant particles to the surface of the part. This unique binding system does not promote corrosion of the surface as a braze alloy would. Further, it permits application of the coating using a soft pliable PTFE based tape which can closely adhere to the surface of the metal part.

The preceding has been a description of the present invention along with preferred methods of practicing the present invention. However, the invention itself should only be defined by the appended claims wherein we claim:

What is claimed is:

1. A method of coating a metal surface with a first corrosion resistant metal selected from the group consisting of Pt, a platinum aluminum alloy and MCrAlY;

applying a first coating of particles of said first metal to said metal surface covering said first coating with an aluminide forming coating;

heating said metal surface and said metalide forming coating causing said metalide forming coating to form a metalide coating on said metal surface;

thereby bonding said particles of said first metal to said metal surface with a metalide coating;

wherein said aluminide forming coating comprises a second metal and a halide carrier;

wherein said second metal is selected from the group consisting of aluminum, chromium, aluminum chromium alloy, silicon aluminum alloy, titanium aluminum alloy, and vanadium aluminum alloy;

wherein said first coating of particles of corrosion resistant metal is applied to said surface with a binder.

2. The method claimed in claim 1 wherein said aluminide forming coating is a tape having a binder wherein said binder is polytetrafluoroethylene.

3. The method claimed in claim 1 wherein said aluminide forming coating is a sintered preform.

4. The method claimed in claim 1 wherein said corrosion resistant metal is combined with a second binder and formed into a second tape, which is placed on said surface.

5. The method claimed in claim 1 wherein said first corrosion resistant metal is MCrAlY wherein M is selected from the group consisting of Co, Ni and mixtures thereof.

6. The method claimed in claim 1 wherein the corrosion resistant metal is platinum.

7. The method claimed in claim 1 wherein said metal surface is heated to a temperature of about 1950° to 2000° Fahrenheit for 2 to about 6 hours.

8. The method claimed in claim 4 wherein said first tape is bonded to said second tape and second tape is bonded to said metal surface.

9. A method of forming a platinum coating on a metal surface comprising:

positioning a coating tape over a portion of said metal surface, said tape comprising an alloy comprising platinum and aluminum and optionally one or more metal selected from the group consisting of aluminum, chromium, aluminum chromium alloy, silicon aluminum alloy, titanium aluminum alloy, vanadium, and vanadium aluminum alloy, said tape further comprising a halide carrier compound and a metal oxide filler and a binder;

heating said surface to a temperature effective to cause said binder to evaporate to cause said alloy to react with said carrier and said metal surface to provide a platinum coating on said metal surface.

10. The method claimed in claim 9 wherein said alloy includes a metal selected from the group consisting of Ni and Co.

* * * * *